US011178925B2

(12) United States Patent
Fischer

(10) Patent No.: US 11,178,925 B2
(45) Date of Patent: Nov. 23, 2021

(54) GARMENT WITH COMPRESSION PANELS

(71) Applicant: Bonnie Fischer, New York, NY (US)

(72) Inventor: Bonnie Fischer, New York, NY (US)

( * ) Notice: Subject to any disclaimer, the term of this patent is extended or adjusted under 35 U.S.C. 154(b) by 241 days.

(21) Appl. No.: 16/017,528

(22) Filed: Jun. 25, 2018

(65) Prior Publication Data

US 2019/0246717 A1 Aug. 15, 2019

Related U.S. Application Data

(60) Provisional application No. 62/631,137, filed on Feb. 15, 2018.

(51) Int. Cl.

| | |
|---|---|
| ***A41D 27/00*** | (2006.01) |
| ***A41D 27/24*** | (2006.01) |
| ***A41B 1/08*** | (2006.01) |
| ***A41C 3/00*** | (2006.01) |
| ***A41D 1/22*** | (2018.01) |
| ***A41D 7/00*** | (2006.01) |
| ***A41D 1/06*** | (2006.01) |
| ***A41D 15/00*** | (2006.01) |
| ***A41D 1/089*** | (2018.01) |

(52) U.S. Cl.

CPC ..... *A41D 27/00* (2013.01); *A41B 1/08* (2013.01); *A41C 3/005* (2013.01); *A41D 1/06* (2013.01); *A41D 1/089* (2018.01); *A41D 1/22* (2013.01); *A41D 7/00* (2013.01); *A41D 15/00* (2013.01); *A41D 27/24* (2013.01); *A41B 2400/38* (2013.01); *A41D 2300/50* (2013.01); *A41D 2400/38* (2013.01)

(58) Field of Classification Search

CPC ..... A41D 27/00; A41D 1/089; A41C 3/0014; A41C 3/0021; A41C 3/04

USPC ..... 450/3, 36

See application file for complete search history.

(56) References Cited

U.S. PATENT DOCUMENTS

| | | | | |
|---|---|---|---|---|
| 1,254,043 | A * | 1/1918 | James | A41C 3/08 450/31 |
| 6,145,132 | A | 11/2000 | Towner | |
| D606,285 | S | 12/2009 | Schindler | |
| D616,627 | S | 6/2010 | Schindler | |
| D622,477 | S | 8/2010 | Schindler | |
| D623,377 | S | 9/2010 | Schindler | |
| D632,051 | S | 2/2011 | Schindler | |
| D632,052 | S | 2/2011 | Schindler | |
| D632,053 | S | 2/2011 | Schindler | |

(Continued)

FOREIGN PATENT DOCUMENTS

JP 2006-316359 A 11/2006

OTHER PUBLICATIONS

International Search Report and Written Opinion in International Application No. PC1/US2019/018214, dated Apr. 15, 2019 (10 pages).

(Continued)

*Primary Examiner* — Timothy K Trieu

(74) *Attorney, Agent, or Firm* — Brenesch, Friedlander, Coplan & Aronoff LLP

(57) ABSTRACT

A garment includes an outer fabric of a first material and an inner panels of a second material. The inner panels are attached to the outer fabric in a way that allows them to be moved towards a front and a back of the garment. For example, the inner panels are movable related to each other and the outer fabric.

26 Claims, 8 Drawing Sheets

(56) References Cited

U.S. PATENT DOCUMENTS

| | | | | |
|---|---|---|---|---|
| D656,298 | S | 3/2012 | Schindler | |
| D665,558 | S | 8/2012 | Schindler | |
| D666,384 | S | 9/2012 | Schindler | |
| D667,607 | S | 9/2012 | Schindler | |
| 8,568,195 | B1 | 10/2013 | Schindler | |
| 9,015,863 | B2 * | 4/2015 | Brown | A41D 13/0015 2/69 |
| 9,022,833 | B2 * | 5/2015 | Deming | A41C 3/0064 450/30 |
| 2005/0246820 | A1 | 11/2005 | Davenport | |
| 2006/0230491 | A1 | 10/2006 | Levy | |
| 2007/0205481 | A1 * | 9/2007 | Ishida | H01L 21/02658 257/479 |
| 2008/0134409 | A1 | 6/2008 | Karasina | |
| 2011/0003533 | A1 | 1/2011 | Caruso et al. | |
| 2011/0214216 | A1 * | 9/2011 | Zarabi | A41D 1/00 2/69 |
| 2011/0219513 | A1 * | 9/2011 | Hendrickson | A41C 3/04 2/113 |
| 2012/0266347 | A1 | 10/2012 | DiLorenzo | |
| 2014/0273734 | A1 | 9/2014 | Gordon | |
| 2015/0208734 | A1 | 7/2015 | Callahan | |
| 2017/0303606 | A1 * | 10/2017 | Curry | A41F 15/002 |
| 2019/0116898 | A1 | 4/2019 | Ulrich et al. | |

OTHER PUBLICATIONS

International Search Report and Written Opinion in International Application No. PCT/US2018/057158, dated Mar. 13, 2019 (12 pages).
U.S. Appl. No. 62/576,330, filed Oct. 24, 2017 (89 pages).

* cited by examiner

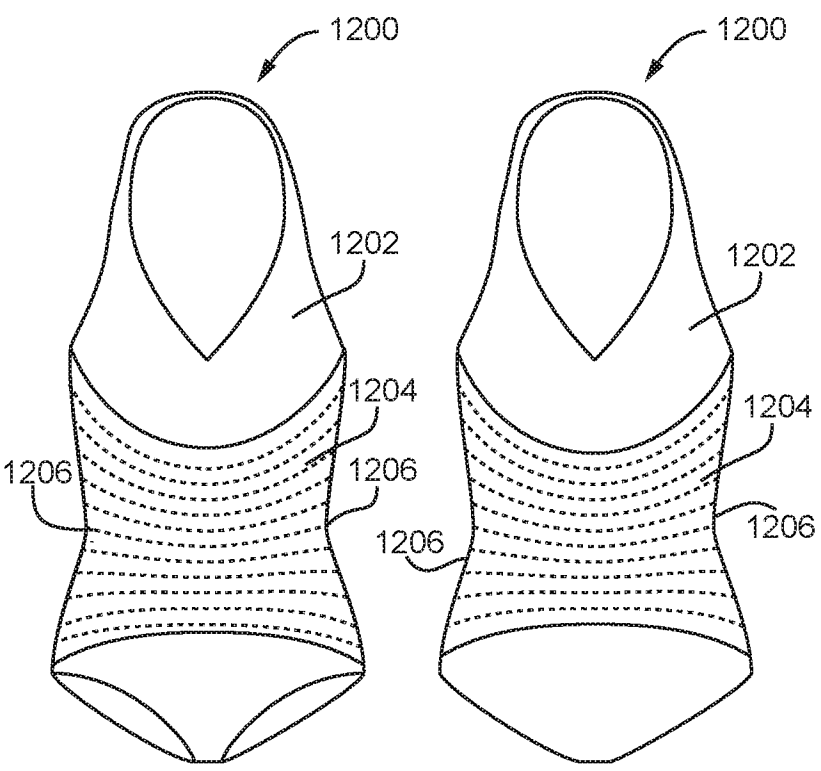
FIG.12A
FIG.12B
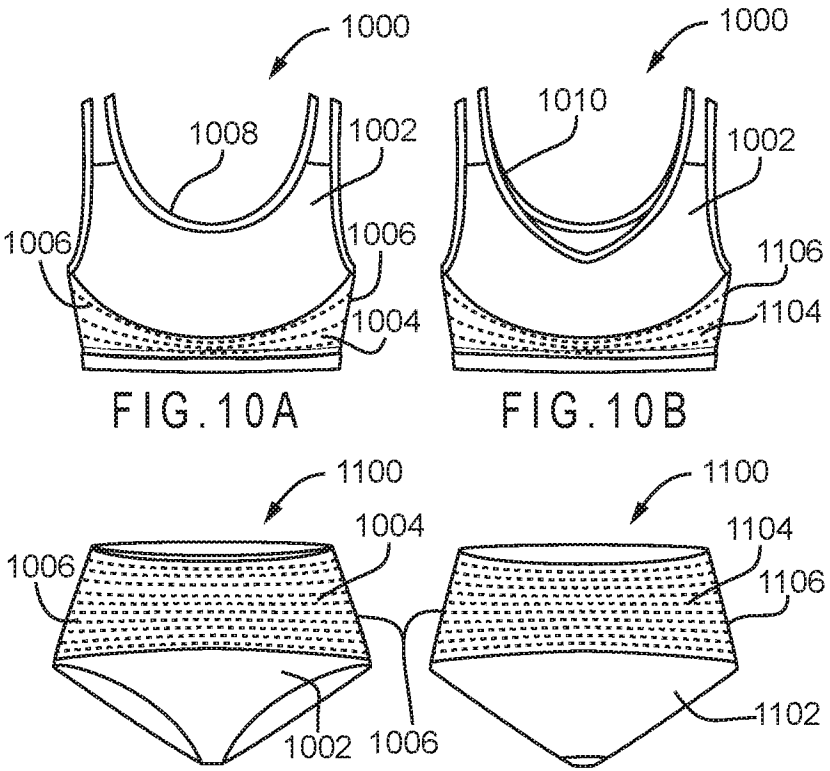
FIG.10A
FIG.10B
FIG.11B
FIG.11A

GARMENT WITH COMPRESSION PANELS

CROSS REFERENCE TO RELATED APPLICATIONS

This application claims the benefit of U.S. Provisional Application No. 62/631,137, filed Feb. 15, 2018, the entirety of which is incorporated by reference herein.

BACKGROUND

A foundation garment, including shapewear or shaping underwear, can be designed to temporarily alter the wearer/user's body shape, and in some cases to achieve what some may view as a fashionable figure. A function of some foundation garments is to smooth and/or support one or more bodily features.

SUMMARY

In one aspect, a garment includes an outer fabric of a first material and at least one inner panel of a second material. The outer fabric is arranged to be continuous such that when the garment is worn by a person (e.g. a "user"), the garment encircles a section of the user's body. The outer fabric includes an inner surface and an outer surface. When the garment is worn by a user, the inner surface faces and/or engage the user's body, and the outer surface faces away from the user's body. The at least one inner panel is attached to the outer fabric in a manner that allows the at least one inner panel to be moved between a first position proximate to a first portion of the inner surface of the outer fabric and a second position proximate to a second and opposite portion of the inner surface of the outer fabric.

In another aspect, a method for manufacturing a garment includes providing an outer fabric including a first material. Further, a first panel including a second material is attached to the outer fabric. A second panel, including a third material, can also be attached to the outer fabric, where the first panel and the second panel are separately movable in relation to each other and the outer fabric.

This summary is provided merely for purposes of summarizing some example embodiments to provide a basic understanding of some aspects of the disclosure. Accordingly, it will be appreciated that the above described example embodiments are merely examples and should not be construed to narrow the scope or spirit of the disclosure in any way. Other embodiments, aspects, and advantages of various disclosed embodiments will become apparent from the following detailed description taken in conjunction with the accompanying drawings which illustrate, by way of example, the principles of the described embodiments.

BRIEF DESCRIPTION OF DRAWINGS

FIGS. 10A-B are front and rear elevation views, respectively, of an example swim top.

FIGS. 11A-B are front and rear elevation views, respectively, of an example swim bottom.

FIGS. 12A-B are front and rear elevation views, respectively, of an example one-piece swimsuit.

DESCRIPTION

Figure 1A:
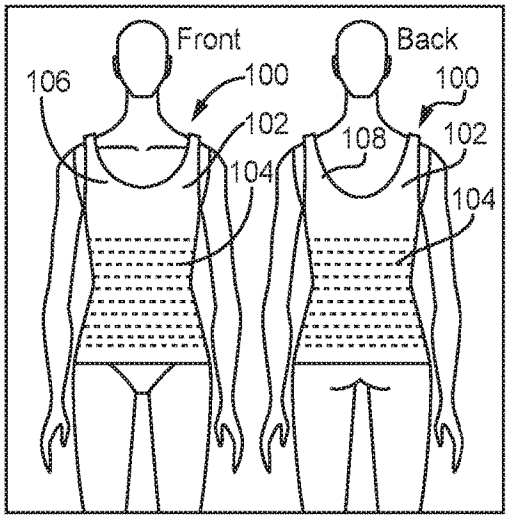
FIGS. 1A-F are front and rear elevation views of an example tank top garment that includes an outer fabric and two inner compression panels, each figure illustrating a different configuration of the tank top garment.

In one exemplary embodiment of a garment, the garment can include an outer fabric and one or more inner compression panels. While the garment can include any number of inner compression panels, for ease of description, garments herein shall be generally described with two inner compression panels. The outer fabric is arranged to be continuous such that when the garment is worn by a user, the garment generally encircles a section of the user's body, such as for example, the user's torso, midsection, hips/thighs, etc. For example, depending on the style of garment, if the garment is to be worn around the user's torso or midsection, the garment can be pull over the user's head and shoulders until the garment is position as desired around the torso or midsection. Alternatively, the user can insert his or her legs into the garment and pull the garment upward until the garment is position as desired around the torso or midsection.

The outer fabric includes an inner surface and an outer surface. When the garment is worn by a user, the inner surface faces and/or engage the user's body, and the outer surface faces away from the user's body. The inner compression panels can be attached to the outer fabric in a manner that allows each of the inner compression panel to be independently moved between a first position proximate to a first portion of the inner surface of the outer fabric and a second position proximate to a second and opposite portion of the inner surface of the outer fabric. As will be subsequently described herein in detail, both inner compression panels can be worn towards a front of the garment and engage a front portion of the user's body, both inner compression panels can be worn towards a back of the garment and engage a back portion of the user's body, or one inner compression panel can be worn towards the front of the garment and engage a front portion of the user's body and one inner compression panel can simultaneously worn towards the back of the garment and engage a back portion of the user's body. The arrangement of the inner compression panels can be determined by the results that a user desires to achieve from wearing the garment. Types of garments that can utilize inner compression panels can include, but are not limited to, short sleeve and long sleeve shirts, tank tops, bras, pants, shorts, skorts, swimsuits, skirts, dresses, baby doll tops, hosiery, etc. For the sake of explanation, the described garments are shown as women's garments, but the inner compression panels can be incorporated in garments for men and children too.

FIGS. 1A-F each illustrate front and rear elevation views of an unique arrangement of an example tank top garment 100. The tank top garment 100 includes an outer fabric 102 and two inner panels 104 that provide compression forces to portions of a user's body when the tank top garment is worn by the user. For sake of explanation, in the figures the inner panels 104 are illustrated as visible though the outer fabric 102. In general, however, the inner panels 104 are hidden from view behind the outer fabric 102. In some implementations, however, the outer fabric 102 can be constructed from a transparent, or semi-transparent, material, so that the inner panels 104 are visible through the outer fabric 102. In some examples, the outer fabric 102 is manufactured from a substantially noncompressive material and the inner panels 104 are manufactured from a substantially compressive fabric. In some examples, the outer fabric 102 includes compression. The inner panels 104 can all include the same amount of compression as each other, or varying amounts of compression, including no compression, depending on an implementation. In some examples, the outer fabric 102 and the inner panels 104 include the same type of fabric. The terms "provide compression" and "compressive fabric" as used herein and in reference to garments generally mean that a fabric or material is arranged with elastic properties such that the material can be stretched such that it expands to accommodate a body portion and, thus, applies a compressive force on the body portion corresponding to the amount the material is stretched to accommodate the body portion.

Figure 1B:
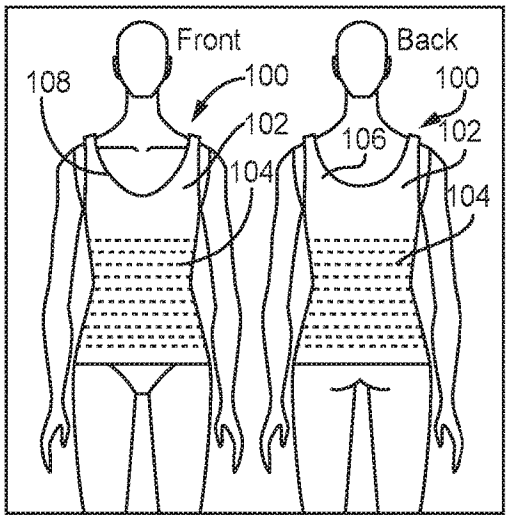
Figure 1C:
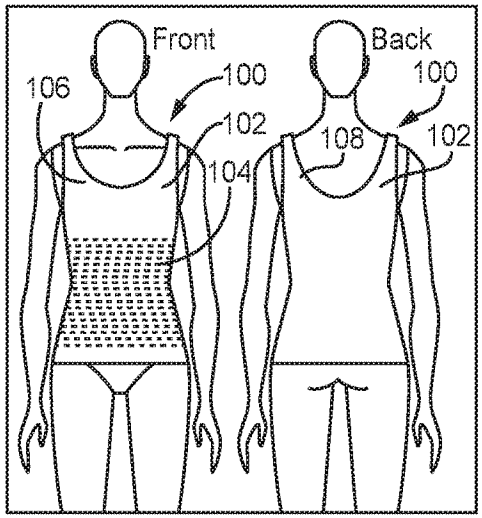
Figure 1D:
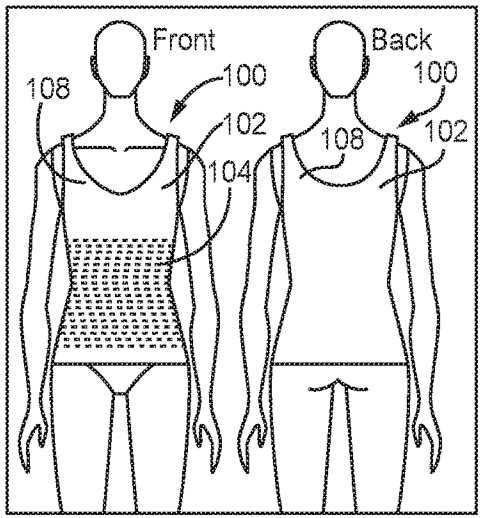
Figure 1E:
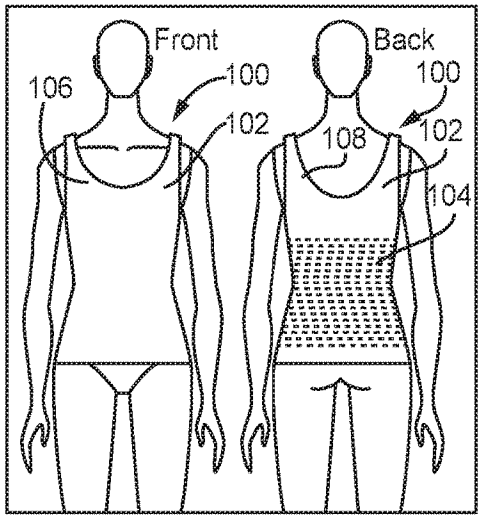
Figure 1F:
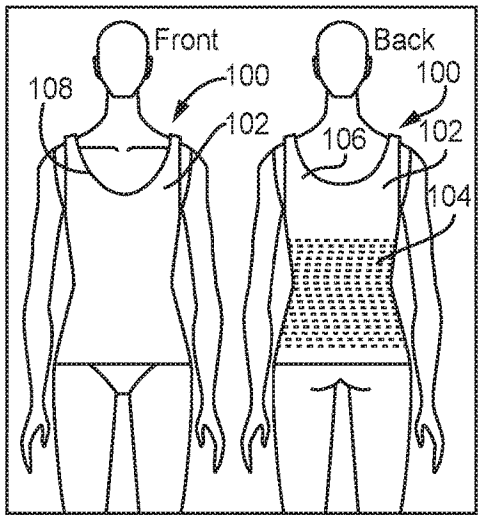

In FIGS. 1A-1F, the garment 100 can be reversible from front to back and the inner panels 104 can be arranged in three different configurations to provide the user with six different wearing options. For example, the garment 100 can include a first neck line 106 on a first side of the garment 100 and a second neck line 108 on a second side of the garment 100 to provide the user the option to wear either the first neck line 106 and the second neck line 108 as the front or the back of the garment 100. FIGS. 1A, 1C and 1E show the user wearing the first neck line 106 as the front of the garment 100, and FIGS. 1B, 1D and 1F show the user wearing the second neck line 108 as the front of the garment 100. The neck lines can include, but are not limited to, a vee neck, scoop neck, crew neck, round neck, u-neck, deep scoop neck, deep vee neck, etc. In some examples, the first neck line 106 and the second neck line 108 are the same.

The inner panels 104 can be arranged in a number of different shapes. For example, each inner panel can be arranged in a generally rectangular shape. In another example, as further discussed in reference to FIG. 4, a pair of inner panels 104 can be arranged from a single continuous material that is attached to the outer fabric 102 in a manner that functionally results in two inner panels 104 that can move independent of each other. In some examples, the inner panels 104 all have the same or similar sizes and/or the same or similar shapes compared to each to other panel. In other examples, the inner panels 104 include different sizes and/or shapes compared to each other. For example, a first inner panel 104 can be bigger or smaller than a second inner panel 104, or generally round instead of generally rectangular, etc. In some examples, the first inner panel 104 covers/compresses a different, or partially different, part of the user's body than the second inner panel 104.

Figures 2A, 2B, 2C, 2D:
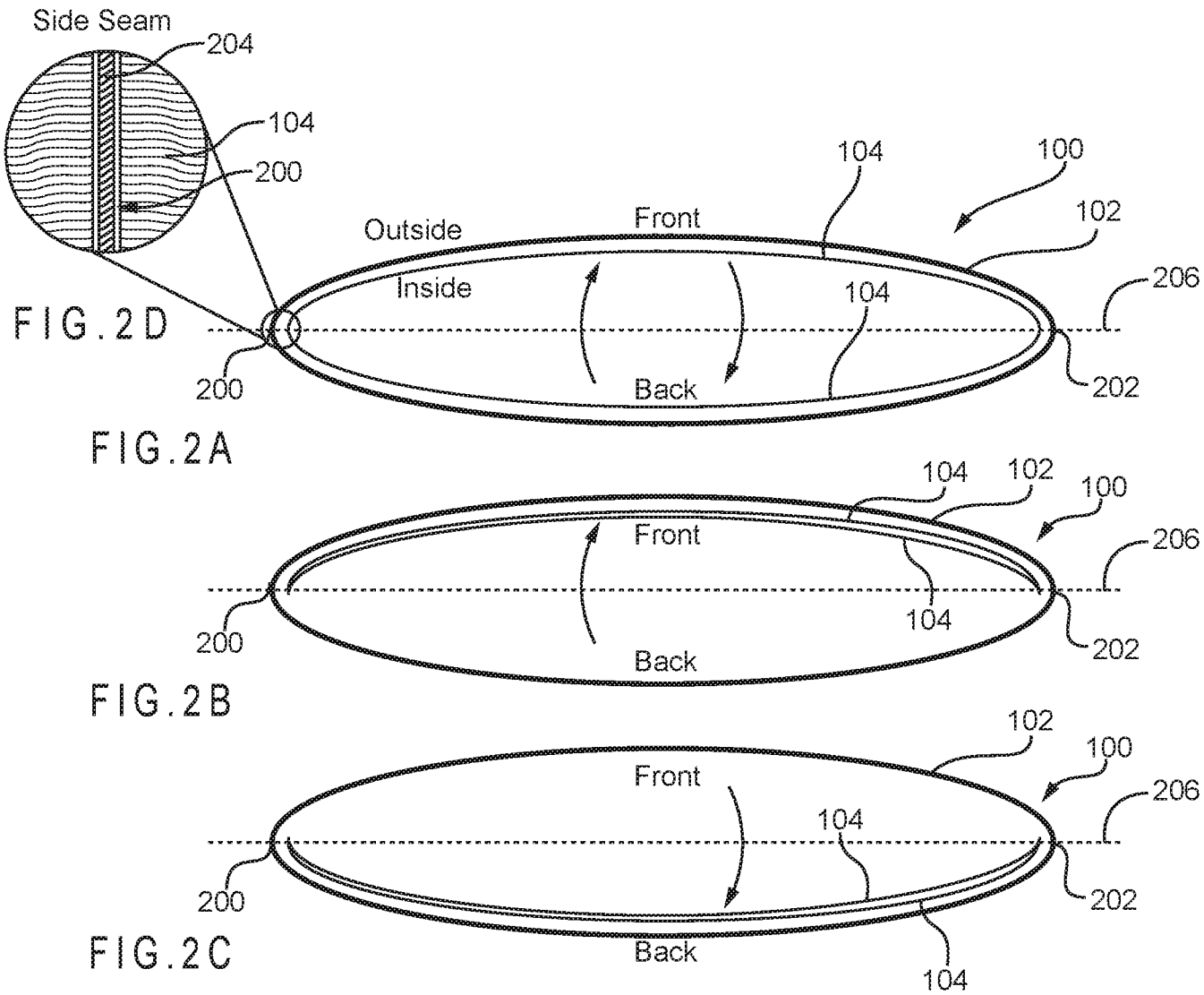
FIGS. 2A-C are top views of the example tank top garment of FIG. 1, each figure illustrating a different configuration of the tank top garment.
FIG. 2D is a detail view of an exemplary method of attaching an inner panel to the outer fabric.

FIGS. 2A-C are top views schematically illustrating the arrangement of the inner panels 104 relative to the outer fabric 102 of the garment 100. Referring also to FIGS. 1A-F, the inner panels 104 can attach to an inside of the outer fabric 102 by attaching a first side of the inner panel 104 along a first side seam 200 and attaching a second and opposite side of the inner panel 104 along a second side seam 202. In this example, the inner panels 104 are free from any additional attachments to the outer fabric 102, which allows the inner panels 104 to move from one side of the garment 100 to the opposite side of the garment 100, e.g., from front to back, and back to front, of the garment 100, within the outer fabric 102. As used herein, the terms "front" and "back" are not inherent properties of the garment or components of the garment, the terms are points of reference that facilitate the description of the garment 100. The term "front" means the section or portion of the garment 100 or outer fabric 102 that is positioned proximate to the front of the user's body when the garment 100 is worn by the user, and conversely, the term "back" means the section or portion of the garment 100 or outer fabric 102 that is positioned proximate to the back of the user's body when the garment is worn by the user.

In some examples, the side seams 200, 202 are not visible from an outside of the outer fabric 102. FIG. 2D is a detail view of an exemplary method of attaching an inner panel 104 to the outer fabric 102. In FIG. 2D, a detailed view of an example stitch 204 secures the inner panels 104 to the side seam 200 of the outer fabric 102, e.g., as viewed from the inside of the garment 100. In some examples, an overlock stitch can be used to secure the inner panels 104 to the side seams 200, 202, e.g., including a four thread safety stitch to help further secure the inner panels to the outer fabric 102. By attaching the inner panels 104 to the side seams 200, 202, the inner panels 104 are configured to separately move in relation to each other and in relation to the outer fabric 102. In some examples, the side seams 200, 202 are positioned along an imaginary centerline 206 of the garment 100. In other examples, the side seams 200, 202 can be positioned in front of or behind the imaginary centerline 206.

FIGS. 1A-1F illustrate three configurations for arranging two inner panels 104 relative to the outer fabric 102 of a garment 100. FIGS. 1A, 1B and FIG. 2A illustrate the garment 100 with one inner panel 104 positioned towards the front of the garment 100 and the other inner panel 104 positioned towards the back of the garment 100. FIGS. 1C, 1D and FIG. 2B illustrate both inner panels 104 positioned toward the front of the garment 100, and, thus, no inner panels 104 is positioned toward the back of the garment 100. FIGS. 1E, 1F and FIG. 2C illustrate both inner panels 104 positioned toward the back of the garment 100, and, thus, no inner panels 104 is positioned toward the front of the garment 100. As will be understood, the configurations described above provide the user with the flexibility and options to apply compression/shaping to different parts of the user's body, and to selectively increase or decrease such compression/shaping based on the configuration of the two inner panels 104. This is to say that in the example of the garment 100 that includes two inner panels 104, the user has the option of positioning both inner panels 104 towards the front of the garment 100 to increase the compression/shaping applied to the front of the user's body; position both inner panels 104 toward the back of the garment 100 to increase the compression/shaping applied to the back of the user's body; or position one inner panel 104 towards the front of the garment 100 and one inner panel 104 towards the back of the garment 100 to apply compression/shaping to both the front and back of the user's body. In this way, the user can control an amount of compression/shaping force applied to the stomach or "tummy" area of the user and/or control an amount of compression/shaping force applied to the rear area along the waistline and above (sometimes colloquially referred to as "muffin area" or "love handles") of the user. The user choices in positioning the inner panels 104 can be determined based on one or more of body types, outer garment types, mood, activity, or intended use (e.g., slimming, smoothing, medical, etc.).

While two inner panels 104 are described for ease of explanation, one inner panel 104 or more than two inner panels 104 can be incorporated into the garment, e.g., based on an implementation of the garment. For example, in a garment with one inner panel 104, the inner panel 104 can be positioned toward the front or toward the back of the garment to provide compression/shaping support to the chosen area of the user's body, leaving the opposite side of the user's body without added compression/shaping support. Alternatively, more than two inner panels 104 can be incorporated into the garment. In the case of more than two inner panels 104, in some examples, all of the inner panels 104 can be positioned toward the front of the garment, all of the inner panels 104 can be positioned toward the back of the garment, or a determined number of inner panels 104 can be positioned toward the front of the garment and the remaining inner panels 104 can be positioned toward the back of the garment.

In one example, the garment can includes five inner panels 104. In such a garment, the user can configure the garment in multiple arrangements, such as, the user can position four inner panels 104 toward the front of the garment and one inner panel 104 toward the back of the garment; the user can position three inner panels 104 toward the front of the garment and position two inner panels 104 toward the back of the garment; the user can position two inner panels 104 toward the front of the garment and three inner panels 104 toward the back of the garment; the user can position one inner panel 104 toward the front of the garment and four inner panels 104 toward the back of the garment; position all of the inner panels 104 toward the front of the garment and no inner panels 104 toward the back of the garment; or the user can position all of the inner panels 104 toward the back of the garment and no inner panels 104 toward the front of the garment.

Figures 3A, 3B:
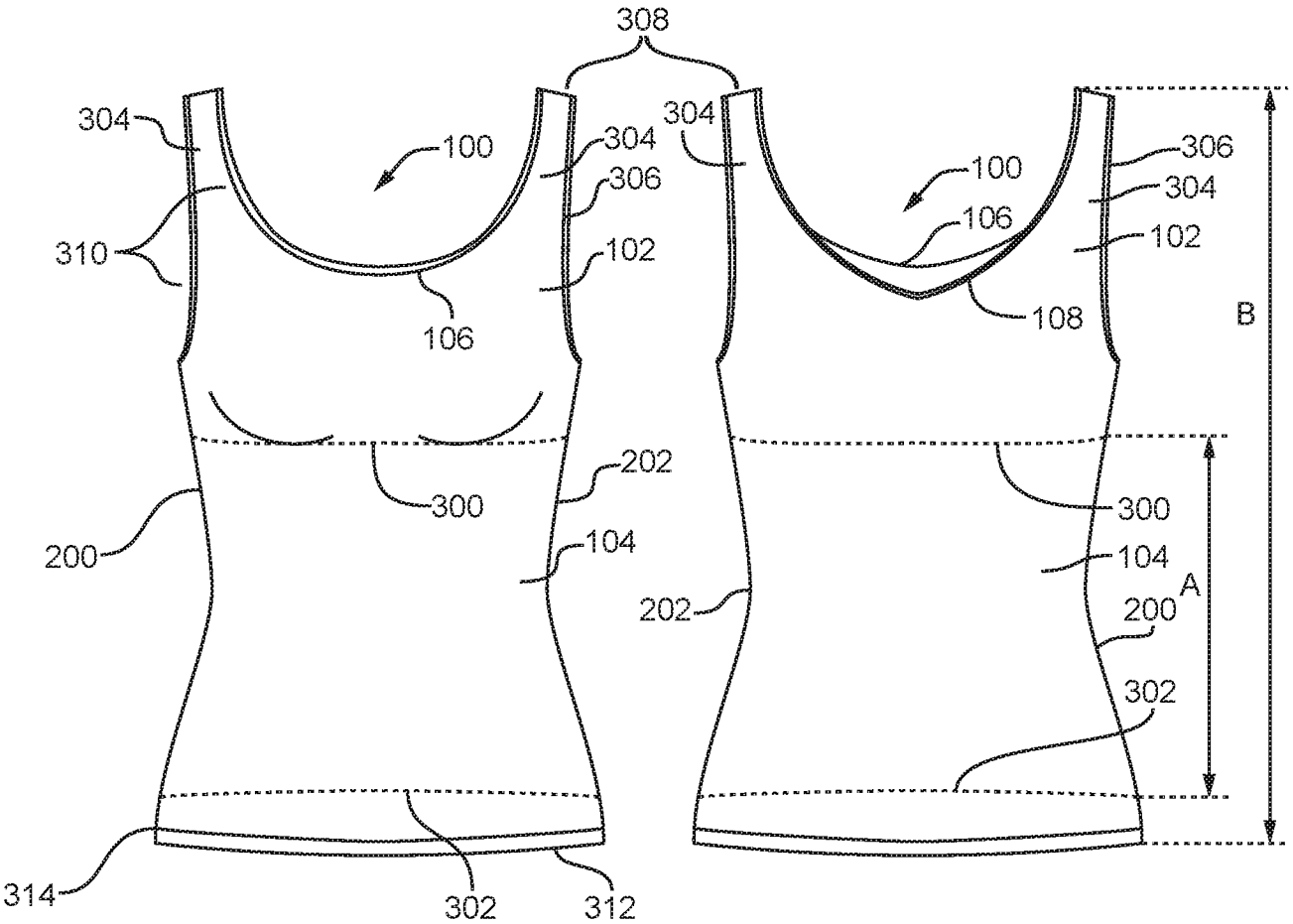
FIGS. 3A-B are front and rear elevation views of the example tank top garment of FIG. 1.

FIG. 3A illustrates a front elevation view and FIG. 3B illustrates a back elevation view of the example garment 100 of FIG. 1. The outlines of the inner panels 104 are illustrated as visible for the sake of explanation, but in practice may not obscured by the opaque nature of the outer fabric 102. In some examples, the inner panels 104 can include a scoop down shape on a top side 300 of the inner panels 104, e.g., to accommodate for bust shape and/or avoid interfering with a bra, and a scoop up shape on a bottom side 302 of the inner panels 104, e.g., to accommodate for hip movement. The scoop up shape can also provide for the bottom side 302 so that the bottom of the inner panel 104 does not extend below the bottom of the outer fabric 102 when worn by the user, e.g., as the garment shifts when the user moves.

In some examples, straps 304 form armholes 306 that match in shape when viewed from the front or the back. Shoulder seams 308 can be placed in a middle of the straps 304 and connect with overlock shoulder seams. In some examples, the neck 106, 108 and armhole 306 can be manufactured with 6 mm flat elastic, overlocked to the outside and turned and secured with a two-needle stitch to expose 2 mm of elastic. A bottom end 312 of the garment 100 can include a half inch, two-needle cover hem 314. In some examples, a height A of the inner liner 104 can be less than a height B of the outer fabric 102. In some examples, the height A of the inner panel 104 extends downward from the bottom of a bust of the garment 100 to a top of the hips of the user. In some examples, a size of each inner panel 104 is the same as each other inner panel 104 of the garment 100. In some examples, the inner panels 104 can include different sizes from each of the inner panels 104, e.g., a first panel having a smaller or bigger or smaller size than a second panel.

Figure 4:
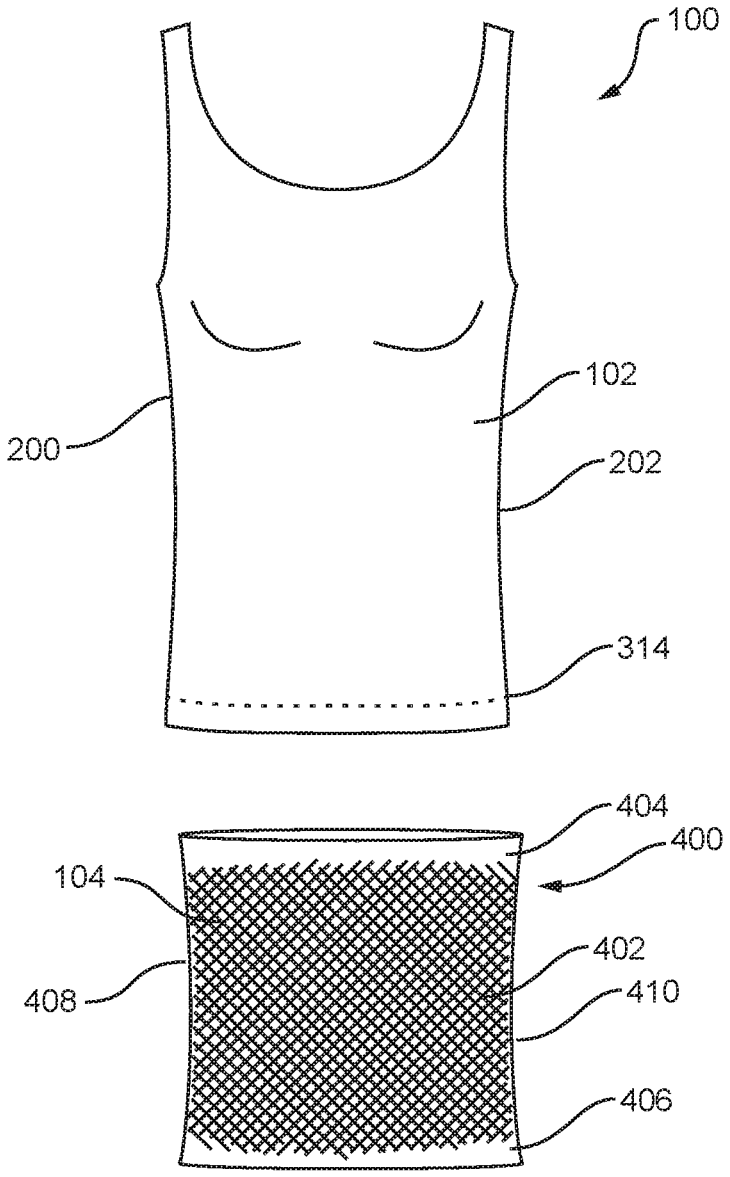
FIG. 4 is a front view of the example tank top garment of FIG. 1 illustrating the inner panels separated from the outer fabric.

FIG. 4 is a front perspective view of the example garment 100 of FIG. 1 showing the inner panels 104 separated from the outer fabric 102. As is shown in FIG. 4, the two inner panels 104 can be formed from a single continuous section of material 400. In some examples, the inner panels 104 can include a shaping zone 402 and non-shaping zones, e.g., a first non-shaping zone 404 at the top of the inner panel 104 and a second non-shaping zone 406 at the bottom of the inner panels 104. In some examples, a top hem of the inner panels 104 is about 0.75 inches, a bottom hem is about 0.5 inches, and a bottom hem 314 of the outer fabric 102 is about 0.75 inches. Other hem sizes can be used. In the example of FIG. 4, a first edge 408 of the single continuous section of material 400 is secured to the outer fabric 102 along the first seam 200, and a second edge 410 of the single continuous section of material 400 is secured to the outer fabric 102 along the second side seam 202. As will be understood, once the single continuous section of material 400 is secured to the outer fabric 102, the single continuous section of material 400 functions as a pair of inner panels 104 that move independently of one another. In an alternative embodiment, the pair of inner panels 104 can be two independent pieces of materials that are each attached to the outer fabric 102 by securing the independent pieces of material to the sided seams 200, 202 of the outer fabric 102.

Example materials for the inner panels 104 and/or the outer fabric 102 include, but are not limited to, cotton, nylon, rayon, spandex, spandex covered yarn, elastane, mesh, jersey knit, etc. Based on an implementation, the same materials, or different materials, can be used for the outer fabric 102 as the inner panels 104. In some examples, the inner panels 104 stretch less than the outer fabric 102, e.g., to provide more compression and/or shaping. In some examples, the outer fabric 102 includes about a 190 to 200 grams per square meter (GSM) target weight, and the inner panels include about a 230 GSM target weight. In some examples, other weights can be used, e.g., based on a desired fit, feel and/or performance. In some examples, a material of the inner panels 104 includes a performance fabric, power fabric or power mesh, etc., e.g. in the shaping zone 400. In some examples, materials for the inner panels 104 can include, but are not limited to, 3, 5, 7, or 9 inch, etc. elastic bands, galloon laces, etc.

The inner panels 104 and/or outer fabric 102 can be manufactured using cut and sew processes and/or with a machine that produces seamless garments, e.g., a SANTONI machine which performs weft knitting. Other seamless knitting machines and/or types of knitting can be used. In some examples, the fabric tube knitted on the seamless knitting machine can have a combination of different patterns and/or include one or more knit types, including but not limited to, a jersey knit, a mesh knit, a rib knit, a jacquard knit, etc. In some examples, the inner panels 104 and/or outer fabric 102 can include an embroider-like logo, and one or more colors, with or without stripes, etc. In some examples, the inner panels 104 and/or outer fabric 102 can include a seam. In some examples, the outer fabric 102 includes an inner seam for capturing the inner panels 104, and the inner panels 104 are seamless. In some examples, an overlock stitch can be used to sew the inner panels 104 to the side seams 200, 202.

Figures 5A, 5B, 5C:
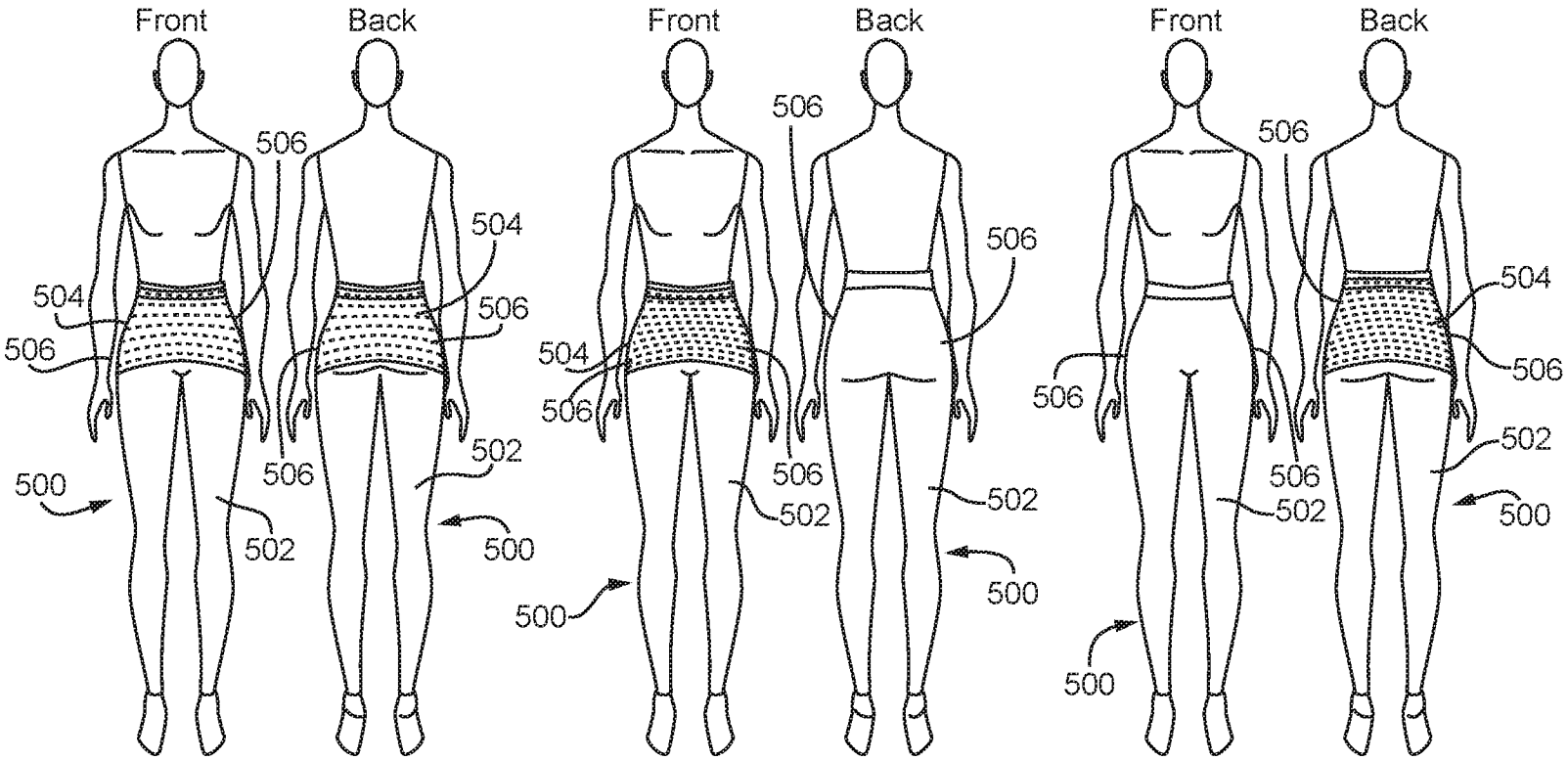
FIGS. 5A-C are each front and rear elevation views of an example of a pair of pants that includes an outer fabric and inner compression panels, each figure illustrating a different configuration of the pair of pants.

FIGS. 5A-C are front perspective views and rear perspective views illustrating three configurations of an example pair of pants 500 that can include a generally noncompressive outer fabric 502 and generally compressive inner panels 504, which can move from front to back within the outer fabric 502. The pair of pants illustrated in FIGS. 5A-5C are commonly referred to as tights or leggings. In some examples, the inner panels 504 are positioned around the hip area of the pair of pants 500. The inner panels 504 can attach to side seams 506 of the outer fabric 502. While the inner panels 504 are illustrated as visible thought the outer fabric 502 for the sake of explanation, in general, the inner panels 504 are not visible through the outer fabric 502. In other examples, the inner panels 504 may be visible through the outer fabric 502.

In FIG. 5A, the user positions at least one inner panel 504 toward the front of the pair of pants 500 and at least one inner panel 504 toward the back of the pair of pants 500, e.g., to provide compression/shaping forces to both the front area of the user's body and the back area of the user's body. In FIG. 5B, the user positions all of the inner panels 504 toward the front of the pair of pants 500, e.g., increasing the compression/shaping forces applied to the front area of the user's body. In FIG. 5C, the user positions all of the inner panels 504 toward the back of the pair of pants 500, e.g., increasing the compression/shaping forces applied to the back area of the user. The inner panels 504 can be secured to the pant 500 and/or utilized in any of the ways described above with regard to garment 100 and FIGS. 1-4. The user determined positioning of the inner panels 504 can vary based on one or more of body types, pant types, mood, activity, use, e.g., slimming, smoothing, medical, etc.

Figures 6A, 6B, 7A, 7B:
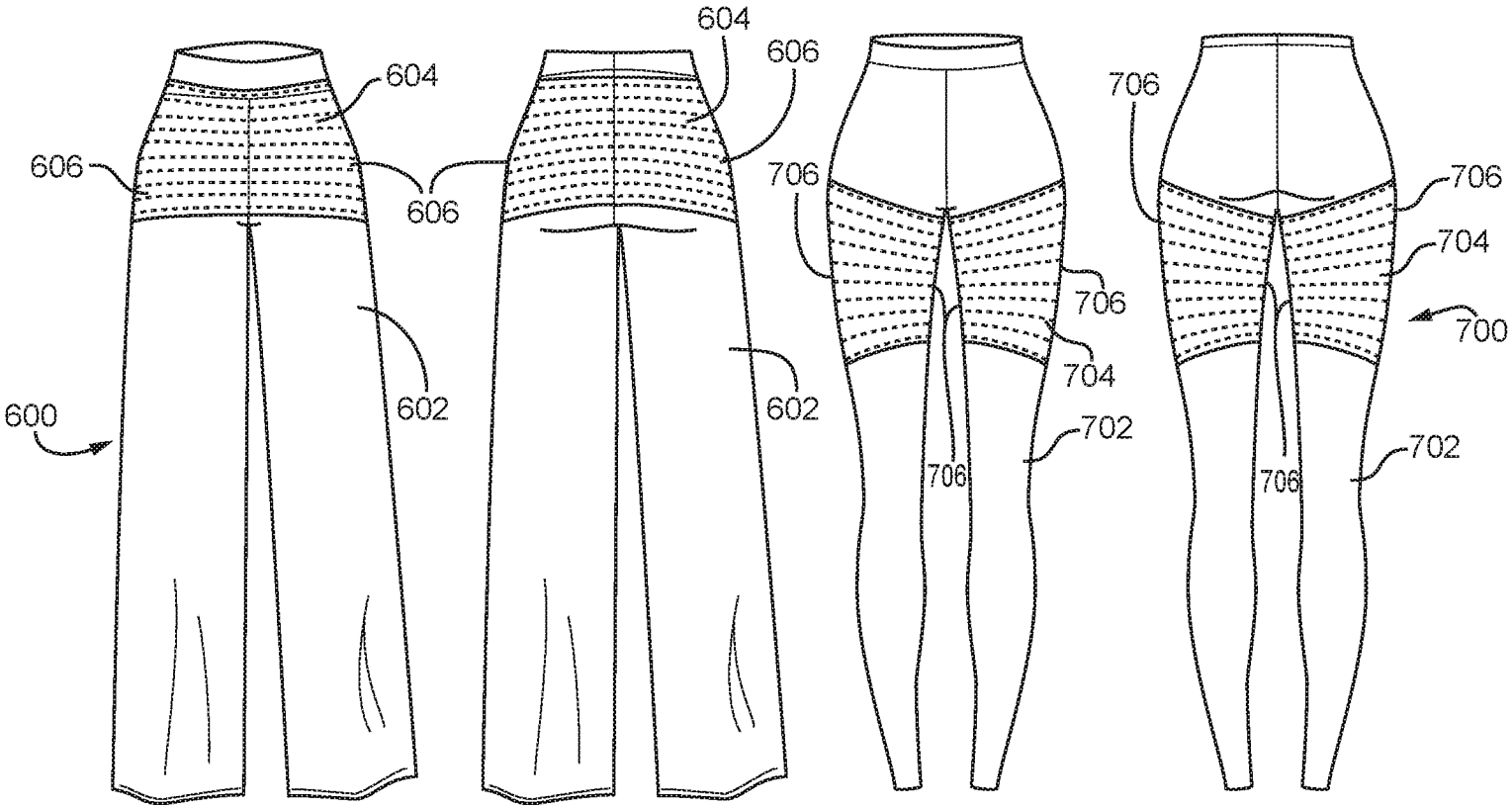
FIGS. 6A-B are front and rear elevation views, respectively, of another style of a pair of pants.
FIGS. 7A-B are front view and rear elevation view, respectively, of an alternate position of the inner panels of the pair of pants of FIGS. 5A-C.

FIGS. 6A-B are a front elevation view and a rear elevation view, respectively, of another style of a pair of pants 600. The pair of pants 600 can incorporate the inner panels 604, for providing compression and/or shaping to the front or back or a user's body or compression and/or shaping to both the front and the back of the user's body. By moving the inner panels 604 toward the front or the back of the pants 600, more shaping can be provided in that area than if the user separates the inner panels 604 to position inner panels 604 in both the front and the back when wearing the pants 600. For example, about the compression/shaping force on the user's body can be increased to either the front or the back of the user's body if both the two inner panels 604 are positioned toward either the front or back of the pants 600, respectively, than if the user positions one of the inner panels 604 toward the front and one of the inner panels 604 toward the back of the pants 600. The inner panels 604 are secured to the pants 600 in such a manner that the inner panels 604 can freely move from the front to the back of the pants 600, and vice versa, so that the user can decide each time that they put on the pants 600 which way to they would position the inner panels 604.

FIGS. 7A-B are a front perspective view and a rear perspective view, respectively, of a pair of pants 700 with an alternative location for the inner panels 704. In this example, the inner panels 704 are positioned to apply compressive/shaping forces to the thigh area of the user. The inner panels 704 can be manufactured in different sizes to provide coverage for more or less of the body, including, in some examples, covering more of the leg, e.g., down to the feet including the calves, and/or more of the hips than illustrated in FIGS. 7A and 7B. Two sets of inner panels 704 can be used, e.g., one set for each leg of the pants 700. The inner panels 704 are secured at the side seams 706 of the pant 500, to allow for movement of the inner panels 704 from a front side to a back side of the pants 700, and vice versa. Also, in the case of two inner panels 704, the user can move both inner panels 704 toward a front of the pants 700, move both inner panels 704 toward a back of the pants 700, or one inner panel 704 toward the front of the pants 700 and one inner panel 704 toward a back of the pants 500, for each leg. In addition to casual users of the pants 700, or other garments described herein, specific types of users can include, but are not limited to, pilots, flight attendants, runners, nurses, pregnant women, people recovering from surgery, people with desk jobs, people with bad backs, and people at risk for blood clots in their legs.

Figure 8B:
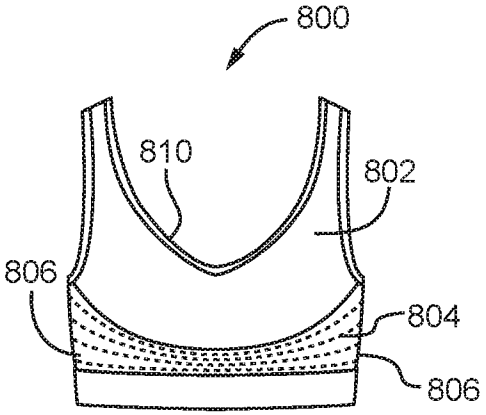
FIGS. 8A-B are front and rear elevation views, respectively, of an example bra.
Figure 8A:
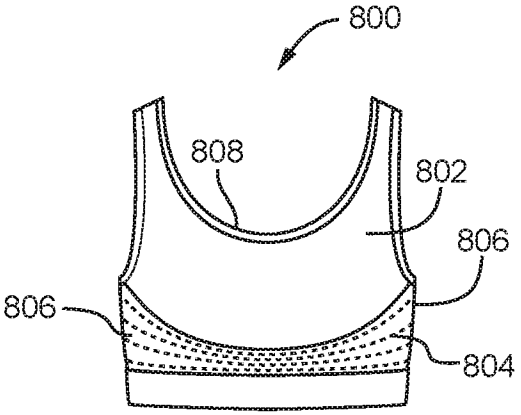

FIGS. 8A-B are a front perspective view and a rear perspective view, respectively, of an example bra 800. The bra 800 can include a generally noncompressive outer fabric 802 and generally compressive inner panels 804, which are movable between the front and back of the bra 800. While the inner panels 804 are illustrated as visible through the outer fabric 802 for the sake of explanation, in general, the inner panels 804 are not visible through the outer fabric 802. In other examples, the inner panels 804 may be visible through a transparent or semi-transparent, outer fabric 802. The user can movably position the inner panels 804, from the front to the back in the bra 800, and vice versa, to provide extra control to a bust and/or a upper back area of the user. For example, positioning two inner panels 804 in the back or front can give more compressive support to the back or front of the user, than if the user positions one or no inner panels 804 in the back or front. The inner panels 804 can attach to side seams 806 of the outer fabric 802, to provide the user with the ability move the inner panels 804 between the front to the back of the bra 800. The bra 800 can include a first neck type 808 on a first side and a second neck type 810 on a second side to provide the user the option to wear the first neck type 808 or the second neck type 810 in the front or the back of the user. The inner panels 804 can be secured to the bra 800 and/or utilized in any of the ways described above with regard to garment 100 and FIGS. 1-4.

Figure 9C:
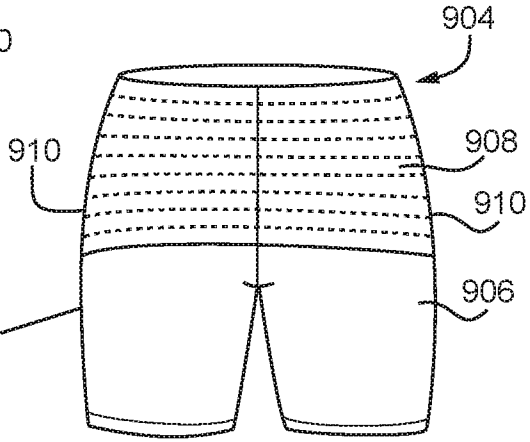
FIGS. 9A-C are a series of front elevation views of an example skort, short and accompanying liner, respectively.
Figure 9B:
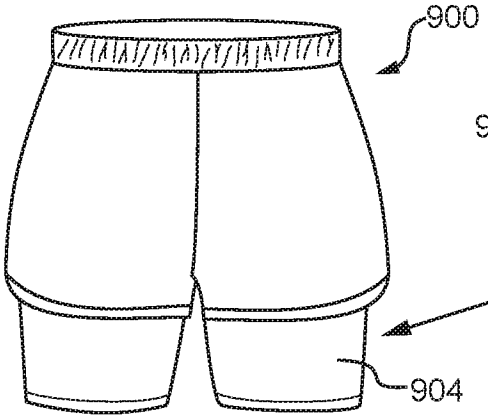
Figure 9A:
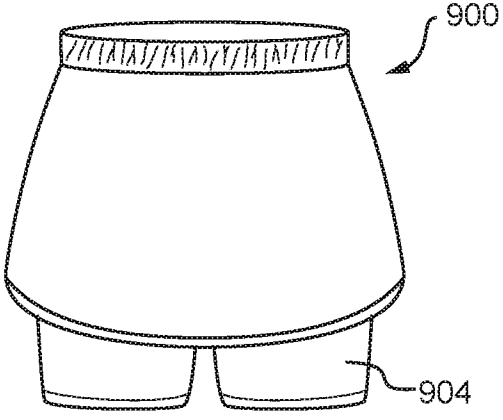

FIGS. 9A-C are front perspective views of an example skort 900, short 902 and accompanying liner 904 for wearing under the skort 900 or the short 902. The liner 904 can include an outer fabric 906 and inner panels 908. While the inner panels 908 are illustrated as visible through the outer fabric 906 for the sake of explanation, in general, the inner panels 906 are not visible through the outer fabric 906. The outer fabric 906 can include some compressive forces to provide overall compression/shaping to the hips and thighs of the user. In some examples the outer fabric 906 is fabricated of materials that do not provide compressive/shaping forces to the user's body when the garment is worn. In either case, the inner panels 908 can be manufactured from a generally elastic material that provides compressive and shaping forces to the user's body when worn. The inner panels 908 are attached to side seams 910 of the liner 904, so that the user can move the inner panels 908 from the front to the back in the liner 904, and vice versa, to provide additional compression as needed to the front and/or back of the user's body. In an example having two inner panels 908, the user can position one inner panel 908 toward the front and one inner panel 908 toward the back of the liner 904 for a single layer of compression in the front and back. Additionally, the user can position both inner panels 908 toward the front of the liner 904 to increase compression/shaping forces applied to the front user's body. Additionally, the user can position both inner panels 908 toward the back of the liner 904 to increase compression/shaping forces applied to the back of the user's body. One or more inner panels 908 can be manufactured with the liner 904, e.g., based on an implementation. The inner panels 908 can be secured to the liner 904 and/or utilized in any of the ways described above with regard to garment 100 and FIGS. 1-4.

FIGS. 10A-B are a front perspective view and a rear perspective view, respectively, of an example swim top 1000. The swim top 1000 can include a generally noncompressive outer fabric 1002 and generally compressive inner panels 1004, which are movable between a front to a back of the swim top 1000. While the inner panels 1004 are illustrated as visible through the outer fabric 1002, for the sake of explanation, in general, the inner panels 1004 are not visible through the outer fabric 1002. In other examples, the inner panels 1004 may be visible through a transparent or semi-transparent, outer fabric 1002. In some examples, the user can movably position the inner panels 1004, between the front and back, to provide extra control to a bust and/or upper back area of the user. For example, positioning two inner panels 1004 toward the back or front can give more compressive/shaping support to the back or front of the user, than if the user positioned one or no inner panels 1004 in the back or front. The inner panels 1004 can attach to side seams 1006 of the outer fabric 1002, to provide the user with the ability move the inner panels 1004 from a front to a back of the swim top 1000. The swim top 1000 can include a first neck type 1008 on a first side and a second neck type 1010 on a second side to provide the user the option to wear the first neck type 1008 or the second neck type 1010 in the front or the back of the swim top 1000. The inner panels 1004 can be secured to the swim top 1000 and/or utilized in any of the ways described above with regard to garment 100 and FIGS. 1-4.

FIGS. 11A-B are a front perspective view and a rear perspective view, respectively, of an example swim bottom 1100. The swim bottom 1100 can include an outer fabric 1102 and inner panels 1104. While the inner panels 1104 are illustrated as visible through the outer fabric 1102 for the sake of explanation, in general, the inner panels 1104 are not visible through the outer fabric 1102. In other examples, the inner panels 1104 may be visible through a transparent or semi-transparent, outer fabric 1102. The outer fabric 1102 can be arranged to provide compressive/shaping forces to the user's body in the hip area of the user. In some examples the outer fabric 1102 includes no compressive/shaping properties. In either case, the inner panels 1104 can be manufactured from a compressive material. The inner panels 1104 are attached to side seams 1106 of the swim bottom 1100, so that the user can move the inner panels 1104 between the front to back in the swim bottom 1100, to provide additional compression/shaping forces as needed to the front and/or back of the user's body. In an example of two inner panels 1104, the user can position one inner panel 1104 toward the front and one inner panel 1104 toward the back of the swim bottom 1100 for a single layer of compression in the front and back, position both inner panels 1104 toward the front of the swim bottom 1100 to increase the compression/shaping forces applied to the front of the user's body, or position both inner panels 1104 toward the back of the swim bottom 1100 to increase the compression/shaping forces applied to the back of the user. One or more inner panels 1104 can be implemented with the swim bottom 1100. The inner panels 1104 can be secured to the swim bottom 1100 and/or utilized in any of the ways described above with regard to garment 100 and FIGS. 1-4.

FIGS. 12A-B are a front perspective view and a rear perspective view, respectively, of an example one-piece swimsuit 1200. The one-piece swimsuit 1200 can include a generally noncompressive outer fabric 1202 and generally compressive inner panels 1204, which are movable between the front to the back of the one-piece swimsuit 1200. While the inner panels 1204 are illustrated as visible through the outer fabric 1202 for the sake of explanation, in general, the inner panels 1204 are not visible through the outer fabric 1202. In other examples, the inner panels 1204 may be visible through a transparent or semi-transparent, outer fabric 1202. In some examples, the user can movably position the inner panels 1204, front to back, to provide extra control to a bust and belly of the user, and/or lower and upper back areas of the user. For example, positioning two inner panels 1204 in the back or front can give more compressive support to the back or front, than if the user positioned one or no inner panels 1204 in the back or front. The inner panels 1204 can attach to side seams 1206 of the outer fabric 1202, to provide the user with the ability move the inner panels 1204 from a front to a back of the swim top 1200. The inner panels 1204 can be secured to the swim top 1200 and/or utilized in any of the ways described above with regard to garment 100 and FIGS. 1-4.

While various embodiments have been described, it can be apparent that many more embodiments and implementations are possible. Accordingly, the embodiments are not to be restricted.

I claim:

1. A garment, comprising:

an outer fabric including a first material, wherein the outer fabric comprises a front side, a back side, a first side seam, and a second side seam; and an inner fabric including a second material, wherein the inner fabric comprises a first panel and a second panel, wherein the inner fabric is attached to the first side seam and the second side seam of the outer fabric, and the first side seam and the second side seam are not visible from an outside of the outer fabric; wherein each of the first panel and the second panel is configured to be movable within the outer fabric between the front side and the back side of the outer fabric such that the garment is capable of being worn with the first panel and the second panel both positioned towards the front side of the outer fabric, both positioned towards the back side of the outer fabric, or the first panel positioned towards the front side of the outer fabric and the second panel positioned towards the back side of the outer fabric.

2. The garment of claim 1, where the first material comprises a noncompressive material and the second material comprises a compressive material.

3. The garment of claim 1, where the first material and the second material comprise a same type of material.

4. The garment of claim 1, where the first material and the second material comprise a compressive material.

5. The garment of claim 1, where at least one of the first material and the second material comprise a seamless material.

6. The garment of claim 1, where the inner fabric is not visible through the outer fabric.

7. The garment of claim 1, where the inner fabric is a different material than the outer fabric.

8. The garment of claim 1, where the outer fabric includes a first neck type on a first side and a second neck type on a second side.

9. The garment of claim 8, where the first neck type comprises a vee neck and the second neck type comprises a scoop neck.

10. The garment of claim 1, where the inner fabric includes at least one of a scoop down for bust shape on a first side and a scoop up for hip movement on a second side.

11. The garment of claim 1, where the outer fabric comprises at least one of a shape of a slimming tank, a bra, a skort, a short, a swimsuit, a dress, a skirt, a tank top, a baby doll top, a hosiery, and a pant.

12. The garment of claim 1, where the first panel and the second panel comprise different compressions.

13. The garment of claim 1, where the first panel and the second panel include a same shape.

14. A method for manufacturing a garment, comprising:

providing an outer fabric including a first material, wherein the outer fabric comprises a front side, a back side, a first side seam, and a second side seam;

providing an inner fabric comprising a first panel including a second material and a second panel including a third material;

attaching the first panel and the second panel to the first side seam and the second side seam of the outer fabric, wherein the first side seam and the second side seam are not visible from an outside of the outer fabric;

wherein each of the first panel and the second panel is configured to be movable within the outer fabric between the front side and the back side of the outer fabric such that the garment is capable of being worn with the first panel and the second panel both positioned towards the front side of the outer fabric, both positioned towards the back side of the outer fabric, or the first panel positioned towards the front side of the outer fabric and the second panel positioned towards the back side of the outer fabric.

15. The method of claim 14, further comprising attaching the first panel and the second panel to a first side seam and a second side seam of the outer fabric.

16. The method of claim 14, where the first material, the second material and the third material comprise a same type of material.

17. The method of claim 14, where the first material, the second material and the third material comprise a compressive material.

18. The method of claim 14, where at least one of the first material, the second material and the third material comprise a seamless material.

19. The method of claim 14, further comprising movably positioning the first panel and the second panel towards a front of the outer fabric, movably positioning the first panel and the second panel towards a back of the outer fabric, or movably positioning the first panel towards the front of the outer fabric and the second panel towards the back of the outer fabric.

20. The method of claim 14, where the inner fabric is a different material than the outer fabric.

21. The method of claim 14, where the outer fabric includes a first neck type on a first side and a second neck type on a second side.

22. The method of claim 21, where the first neck type comprises a vee neck and the second neck type comprises a scoop neck.

23. The method of claim 14, further comprising providing at least one of a scoop down for bust shape on a first side of the first panel and the second panel, and a scoop up for hip movement on a second side of the first panel and the second panel.

24. The method of claim 14, where the first panel and the second panel comprise different compressions.

25. The method of claim 14, where the first panel and the second panel comprise a same shape.

26. The method of claim 14, where the first material comprises a noncompressive material and the second and third materials comprise a compressive material.

* * * * *